United States Patent [19]

Gray

[11] 3,982,892

[45] Sept. 28, 1976

[54] ACTIVATED PEROXY BLEACH COMPOSITION

[75] Inventor: Frederick W. Gray, Summit, N.J.

[73] Assignee: Colgate-Palmolive Company, New York, N.Y.

[22] Filed: July 12, 1974

[21] Appl. No.: 487,889

[52] U.S. Cl. ..... 8/111; 252/99; 252/102; 252/186

[51] Int. Cl.[2] ..... D06L 3/02; D06L 3/06; C11D 7/54

[58] Field of Search ..... 8/111; 252/99, 102, 252/186

[56] References Cited

UNITED STATES PATENTS

| | | | |
|---|---|---|---|
| 3,715,184 | 2/1973 | Kuhling et al. | 8/111 |
| 3,785,984 | 1/1974 | Berg et al. | 252/99 |

*Primary Examiner*—Carman J. Seccuro
*Attorney, Agent, or Firm*—Murray M. Grill; Herbert S. Sylvester

[57] ABSTRACT

An activated peroxy compound bleaching composition includes a peroxy bleaching compound, such as sodium perborate or sodium percarbonate and a mixture of activators for such bleaching compound, which improves the bleaching effect thereof, at least one of which is a di-lower alkanoyl di-lower alkyl glyoxime, such as diacetyldimethylglyoxime, a tetra-lower alkanoyl glycoluril, such as tetraacetylglycoluril or a mixture thereof and at least another of which is a 2-[di(2-hydroxy-lower alkyl)amino]-4,6-dihalo-s-triazine, such as 2-[bis(2-hydroxyethyl) amino]-4,6-dichloro-s-triazine, a 2,4-di-lower alkoxy-6-halo-s-triazine, such as 2,4-dimethoxy-6-chloro-s-triazine or a mixture thereof. For improved stability on storage the activators and/or the peroxy compound may be coated. Preferably, the peroxy bleaching compound and mixture of activators are included in a synthetic organic detergent composition such as one based on anionic and/or nonionic normally solid detergents, preferably with builder salt present, and bleaching is effected during the washing of fabrics or articles made thereof, which may take place in wash waters of various temperatures, even in cold water.

35 Claims, No Drawings

ACTIVATED PEROXY BLEACH COMPOSITION

This invention relates to activated peroxy compound bleaching compositions. More particularly, it relates to such compositions which contain particular types of mixtures of activators which improve the bleaching effects of the compositions while yet not making them undesirably harsh so that they seriously damage the colors of dyed fabrics and articles made therefrom. Thus, such compositions and detergents including them are useful for removing stains from fabrics, whether white or dyed, and can accomplish such result in both hot and cold water.

It is known to utilize peroxy compounds for the bleaching of fabrics to remove stains. Among the most widely used materials for this purpose is sodium perborate, although sodium percarbonate and alkali metal analogues of the sodium salts have also been employed. Such compounds release active oxygen which oxidizes the stain, converting it to a colorless material or to a product which is more readily removable from the fabric substrate. About one gram of sodium perborate per liter of water yields about 100 parts per million of active oxygen. In this calculation and elsewhere in this application, including the claims, when sodium perborate is referred to it will be evident that the tetrahydrate, $NaBO_2.H_2O_2.3H_2O$ is intended. This is the usual commercial form of the material. With respect to percarbonates, the normal percarbonate of commerce, $2Na_2CO_3 3H_2O_2$, usually contains about 12–14% of active oxygen. Similarly, the other peroxy compounds which may be employed in place of some or all of such materials, such as sodium peroxypyrophosphate and sodium peroxysilicate, are used in weights sufficient to produce an equivalent proportion of active oxygen when they are substituted for the perborate or percarbonate. This also applies to other compounds of the types named, such as different hydrates, e.g., sodium perborate monohydrate, which may be substituted for the other hydrates on an equivalent oxygen or hydrogen peroxide production basis. Thus, in this specification and in the claims the proportion of peroxy compound employed will be given with respect to the weight of available oxygen therein.

In Europe, bleaching detergents usually include sodium perborate and the washing and bleaching of laundry are effected by bringing the aqueous laundering medium to boil or near to it, e.g., 85°–100°C., preferably 90°–99°C., at which temperature the perborate is made much more active and much more efficient with respect to bleaching activity. Such bringing to the boil may be effected quickly but is usually gradual, with some washing at low temperatures initially to remove low temperature water soluble stains and soils without fixing certain such stains onto the fabrics by immediate subjection to high temperatures. In the United States and many other countries clothing is not normally boiled. In fact, often home hot water supplies produce water at a temperature of 60°C. or less, sometimes as low as 45°C. Also, modern synthetic polymeric fabric materials that are treated with permanent press or wrinkle resistant finishes often should not be heated to high temperatures during washing and bleaching operations because such finishes tend to deteriorate and/or discolor in aqueous media at elevated temperatures. Many dyestuffs are altered or are too readily removed from fabric substrates by high temperature and such temperatures can cause shrinking or other distortions of the substrate. Furthermore, for energy conservation reasons it has recently been suggested that the use of high water temperatures should be avoided. Therefore, it is especially desirable to employ cold or warm water washing.

The bleaching art has recognized that certain compounds can be employed to activate the peroxy compound bleaching of stains and soils from fabrics. Thus, cotton, linen, polyestercotton blends, nylons, acrylics and various other available materials, whether woven or non-woven, knitted, sewn or otherwise converted to fabric form, can be bleached with an activated peroxy compound bleaching composition, even at relatively low temperatures, due to the presence of the activator and its increasing the activity of the peroxy compound. Among the activators that have been used are diacetyldimethylglyoxime, herein referred to as DDG and tetraacetylglycoluril, herein referred to as TAG. Although useful, when employed in relatively small commercially feasible proportions such activators are not usually capable of sufficiently increasing the activity of the peroxy compound, such as sodium perborate or sodium percarbonate, so as to make its effect in cold or warm water (15° to 50°C.), equivalent to that of the unactivated peroxy compounds, such as sodium perborate, when such are raised to the boil, as in the European method of bleaching and washing.

Recently, certain triazine compounds, such as 2,4-dimethoxy-6-chloro-s-triazine, hereafter called DCT, and 2-[bis(2-hydroxyethyl)amino]-4,6dichloro-s-triazine, hereafter called BHADT, have also been suggested for use as activators for peroxy bleach compounds. However, applicant has found that such activators, even at low temperatures, may adversely affect colors of fabrics in some instances. Furthermore, there are certain stains which they do not remove as satisfactorily as previously known activators. Such differences may be attributed to different operations of the activators, DDG and TAG being "acyl" activators which react with the peroxy anion from the peroxy compound to form a peracid such as a percarboxylic acid, e.g., peracetic acid (in free or wholly or partially neutralized form), while on the other hand, the triazine compounds function differently, with the peroxy anion from the perborate, percarbonate or similar materials displacing chlorine to form a hydroperoxide of the triazine compound or derivative employed. The triazines referred to are 1,3,5- or s-triazines but in suitable cases correspondingly but asymmetrical triazines may be useful.

Prior to the present invention disadvantages of both types of the mentioned activators were known to the applicant and therefore it was surprising that improved bleaching effects were obtained when utilizing a mixture of such an "acyl activator" and such a "triazine activator" with a peroxy compound, such as sodium perborate or sodium percarbonate, with good bleaching being observed with respect to a variety of test stains and against normally stained laundry while at the same time the whiteness of white cottom fabrics was also maintained in mixed loads and objectionable color changes of dyed fabrics, such as Wamsutta, Burlington and Cannon blue cotton-polyester, were minimized. The bleaching results obtained were comparable to and usually were better than those obtained using the same amount of peroxy compound, e.g., sodium perborate, at 99°C., which had been set as a standard to be attained as a result of the research described. The beneficial results obtained are surprising because often activators, bleaches or oxidants will interfere with one another, with one being oxidized by the other. For example, it is known that hydrogen peroxide and hypochlorite bleaches are mutually antagonistic. Such interference does not occur with the present materials. In general, the DCT, with either DDG or TAG, was a stronger bleaching agent than BHADT with either DDG or TAG, using the same amounts of peroxy compound. On the other hand, the BHADT, in combination with DDG or TAG, may give best results with respect to color damage over a wide range of conditions.

In accordance with the invention an activated peroxy compound bleaching composition comprises a peroxy bleaching compound and a mixture of activators for such compound, at least one of which is (a) an activator selected from the group consisting of di-lower alkanoyl di-lower alkyl glyoxime, tetra-lower alkanoyl glycoluril and mixtures thereof and at least another of which is (b) an activator selected from the group consisting of 2-[di(2-hydroxy-lower alkyl)amino]-4,6-dihalo-s-triazine, 2,4-di-lower alkoxy-6-halo-s-triazine and mixtures thereof. Preferably, the activators utilized will be DDG and/or TAG on the one hand and BHADT and/or DCT on the other, with a peroxy compound such as sodium perborate or sodium percarbonate. The bleaching composition may be used as such but is often preferably included as a part of a detergent product so that the bleaching is obtained during washing of the fabric. Such a detergent may be one intended for hot or cold water washing but for energy conservation, dye integrity and maintenance of dimensions of the fabric articles laundered, cold water washing (and sometimes warm water washing) is often preferable.

The peroxy bleaching compounds are inorgaic materials, preferably salts, such as metal salts, more preferably alkali metal salts and most preferably the sodium (or potassium) salts of inorganic peracids, of which sodium perborate and sodium percarbonate are most perferable. When perborate is employed the tetrahydrate is preferred but the monohydrate and other hydrate forms are also useful. Similarly, equivalent amounts of other hydrates of other oxygen-releasing per-compounds may be employed. Sodium peroxypyrophosphate and sodium peroxysilicate are also useful and other suitable peroxy or per-compounds, especially salts, e.g., alkali metal salts, may also be employed, at least in part, under suitable conditions, such as sodium persulfate and sodium peroxide. In general the preferred per-compounds to be activated are those which contain hydrogen peroxide within their structure and which are generally inorganic but may be organic, such as, for example, the peroxide of urea. Inorganic per-compounds are disclosed in U.S. Pat. No. 3,532,634 (Woods), the disclosure of which is hereby incorporated by reference. As was previously mentioned with respect to peroxypyrophosphates, the relative amounts of the peroxy materials employed will be such as are equivalent in active oxygen released.

The activators of the acyl activator class (a) are preferably compounds selected from the group consisting of di-lower alkanoyl di-lower alkyl glyoximes and tetra-lower alkanoyl glycolurils and mixtures thereof and the activators of the hydroperoxide-forming triazine derivative type (b) are preferably compounds selected from the group consisting of 2-[di(2-hydroxylower alkyl-)amino]-4,6-dihalo-s-triazine and 2,4-di-lower alkoxy-6-halo-s-triazines and mixtures thereof. With respect to the di-lower alkanoyl di-lower alkyl glyoximes, the alkanoyls are usually of 2 to 5 carbon atoms, with 2 to 3 carbon atoms being preferred, and normally will be same, although they may be independently selected. Similarly, the alkyl groups, including the alkyls of hydroxyalkyl and alkoxy, may be independently selected but will normally be the same and will generally be of 1 to 4 carbon atoms, with 1 to 2 carbons atoms being preferred. The tetra-lower alkanoyl glycolurils also have alkanoyl substituents of 2 to 5 carbon atoms, with those of 2 to 3 carbon atoms being preferred and with it generally being preferred to have all four alkanoyl groups the same, although they may be independently selected, too. Mixtures of the mentioned compounds of the glyoxime and glycoluril derivative types may be employed, as may be mixtures of individual compounds of each type.

The hydroperoxide-forming triazine compounds of the 2-[di(2-hydroxy-lower alkyl)amino]-4,5-dihalo-s-triazine structure will normally be those wherein the lower alkyls (actually alkylenes) are of 1 to 5 carbon atoms, preferably 1 to 3 carbon atoms, and the halogens are either chlorine or bromine or mixtures thereof, preferably chlorine. the alkyls of the hydroxyalkyl groups may be different but normally are the same and the halogens may be different but normally will also be the same. The 2,4-di-lower alkoxy-6-halo-s-triazine compounds will usually have the lower alkoxy groups of the 1 to 4 carbon atoms, preferably of 1 to 2 carbon atoms, and the halogens will normally be chlorine or bromine, preferably chlorine. The alkoxies will preferably be methyl but sometimes ethyl may be preferred. Generally, the alkoxies and the halogens will be the same but they may be different, too, within the descriptions given. Mixtures of the triazine derivatives of the type resembling BHADT may be made with those of the type resembling DCT and mixtures within each type group may also be made. Generally, however, one compound of each of the (a) and (b) groups, representing the acyl and triazine activators, respectively, will be used, making four general combinations of such types of preferred products.

Although the preferred acyl and triazine activators (a) and (b) are described above, in a broader sense the present invention also relates to improving the activation of peroxy bleach compounds or bleaching per-compounds with mixture of peracid-generating acyl activators and hydroperoxide-forming triazine activators. The words "peracid-generating" and "hydroperoxide-forming" are intended to encompass compounds functioning like those previously described as examples of such classes. For example, among such other acyl activators, which preferably produce percarboxylic acids (or salts), e.g., peracetic acid, are: benzoic anhydride; tetra-acetylethylenediamine; N-acetyldimethylhydantoin N-acetyl-1-phenylhydantoin; ESPC [ethyl sulfophenyl carbonate or salt thereof (the sodium salt is preferred)]; TAED; TACA; CSA; SABS; chlorobenzoic anhydride, p-acetoxybenzoic acid; and various other such compounds of the anhydride ester, acyl halide, acyl cyanurate and acyl amide classes, such as described by Gilbert in a series of articles appearing in *Detergent Age*, June 1967, pages 18–20, July 1967, pages 30–33 and August 1967, pages 26, 27 and 67, by Wood in U.S. Pat. No. 3,532,634 and by Gray in U.S. Pat. No. 3,637,339, all of which are hereby incorporated herein by reference. Also, with respect to both the acyl activators, which are preferably materials which yield peracetic acid for peroxy compound activation, and the hydroperoxide-forming triazine activators, instead of aliphatic substituents such as the alkyl and alkanoyl groups it may sometimes be desirable to employ aromatic substitution. Thus, benzoyl radicals may be the acyl radicals of the activators described above and phenyl groups may substitute for the alkyls. Generally, however, it is preferred to utilize aliphatic substitution. Also incorporated by reference is the disclosure of the Loffelman et al. U.S. patent 3,775,333 for its disclosure of N-acyl azoline acyl activators and the use of mixtures of such activators. The Gilbert references also include description of the abbreviated names of some of the activators.

With respect to the triazine compounds, these are of the formula

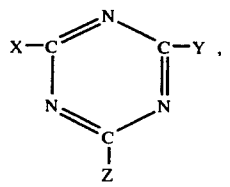

wherein X is halogen (Cl or Br); Z is a solubilizing group (-N-di-lower alkanol; N-lower alkanol-lower alkyl; —O-lower alkyl; -lower alkanol; N-dilower alkyl; N-lower alkyl, lower alkanol and combinations thereof; and Y is either X or Z or a mixture thereof. Although the alkyls are preferably of 1 to 4 carbons they may be of up to 12 carbons too, and aromatic substituents may be present in some cases. In addition to the compounds previously described as representative of the "triazine" activators there may also be used those of the formula given wherein: (1) X is chlorine, Y is chlorine, and Z is methoxy; (2) X is chlorine, Y is chlorine and Z is $-NHCH_3$; (3) X is chlorine, Y is chlorine and Z is $-N(C_2H_5)_2$; and (4) X is chlorine Y is $-NHCH_3$ and Z is $-NHCH_3$. Instead of chlorine, bromine may be substituted.

Although various pH's may be employed for particular bleaching compositions within this invention, sometimes being as low as 8 and as high as 12, it is generally desirable that the pH be within the range of 8.5 to 10.5 and preferably it will be about 9 to 10. At such alkaline pH's effective bleaching is obtained and sensitive dyed fabrics show less damage from the bleaching compositions. Thus, it will often be desirable to employ alkaline reagents such as alkali metal salts, e.g., trisodium phosphate, sodium carbonate, sodium silicate, borax, alkalies and buffers, to adjust the pH of the aqueous bleaching medium. These may be added to the medium separately but preferably are included with the bleaching composition, which is normally in dried, powdered or bead form. In built detergent compositions including the present activated peroxy bleaching compounds the builder salt may serve to adjust the pH to the desirable range. Proportions of alkaline salts similar to those in such built detergents may be employed to adjust the pH in bleaching compositions (without detergents).

In the present bleaching compositions the ratio by weight of peroxy (including per-salt) bleaching compound or mixture thereof to the mixture of activators for such compound is such that the ratio of active oxygen from the peroxy bleaching compound to activators is in the range of about 1:12 to 5:1, preferably about 1:10 to 1:1.7 and most preferably about 1:5. Because the proportion of active oxygen in sodium perborate (as the tetrahydrate) is about 10%, the ratio of sodium perborate to the mixture of activators is in the range of about 5:6 to 50:1, preferably about 1:1 to 6:1 and most preferably about 2:1. However, ratios of greater than 2:1, such as 3:1 and 6:1 may be preferable for bleaching in the presence of colored fabrics, especially if the triazine activator DCT is employed. It has been found that employing larger proportions of perborate in such compositions has a color protective effect. However, a preferred ratio of the active oxygen from the peroxy compound to the sum of the activators will often be about 1:5. All ratios given are by weight. The ratios of the acyl activator (a) to the hydroperoxide-forming triazine activator (b) are usually from 1:5 to 5:1, preferably 1:3 to 3:1 and most preferably about 1:1. Such ratios are especially applicable to the four different mixtures of activators employed with the peroxy compound, such as sodium perborate or sodium percarbonate, in the present bleaching compositions. It is recognized that when changing activators it may sometimes be considered to be desirable to utilize a corresponding molar proportion of the "new" activator and this can be computed from the preferred weight proportions of the preferred activators employed. However, equal weights of such materials are more easily substituted and experience indicates such substitutions are satisfactory.

In use, the concentration of the bleaching composition described above (which composition contains only peroxy compound and mixed activators) in the aqueous medium employed to form the bleaching solution is usually from 0.01 to 0.2%, preferably from about 0.02 to 0.1%. When the bleaching composition is part of a detergent composition, it will normally be about 4 to 60% thereof, preferably 5 to 30% thereof and more preferably about 10 to 20% thereof. The balance is a normal detergent composition, as described herein. The detergent composition concentration in the wash water will usually be from 0.05 to 1%, preferably being about 0.1 to 0.2%, more preferably about 0.15% in the United States and preferably being about 0.7% to 0.9% and more preferably about 0.8% in European countries, where washing methods and machines are different. Thus, although about the same amounts of detergents, bleaching materials and activators are employed in both American and European practice, the European concentrations of such materials in aqueous media are in the range of about 3 to 10 times those of the American practice, preferably about 3 to 6 times the American concentrations, and the volumes of aqueous medium employed are correspondingly (inversely) changed. The bleaching compositions of this invention may be used directly for bleaching purposes or, as is often preferable, may be included in detergent compositions for bleaching and antimicrobial effects. Also, they may be utilized in fabric softening preparations, pre-soak compositions for treatment of laundry before washing, commercial bleaching compositions for bleaching raw fibers, stain removing products, bleaching scouring cleansers, denture cleansers and sterilizing or antimicrobial compositions. However, of these applications, it is preferable to utilize the activated peroxy compound bleaching compositions in detergent products.

Detergent compositions usually include a synthetic surface active agent having detersive properties, which is normally referred to as a synthetic organic detergent. For the purpose of this specification higher fatty acid soaps will be included within this class of anionic synthetic organic detergents. The anionic detergents will normally have from 8 to 26, preferably from 12 to 22 carbon atoms per molecule and usually will include an alkyl or aliphatic chain containing about 8 to 18 carbon atoms, preferably from 10 to 16 carbon atoms in a straight chain alkyl group. The most preferred of such detergents are the alkali metal higher alkyl benzene sulfonates, such as the sodium and potassium salts, in which the higher alkyl groups are of 10 to 18 carbon atoms, preferably at 12 to 15 carbon atoms, and preferably are linear. Other such anionic detergents include the alpha-olefin sulfonates, paraffin sulfonates, ethoxylated alcohol sulfates, alkyl sulfates and sulfated higher alkyl phenyl polyoxyethylene ethanols are preferably as alkali metal salts, such as the sodium salts. A list of such detergents is found in U.S. Pat. No. 3,637,339.

Nonionic detergent compounds may also be employed, often in admixture with an anionic detergent. Such compounds will normally be lower alkylene oxide condensation products, such as polyethylene oxides, which may sometimes have polypropylene oxide present to such an extent that the product is still water soluble. Preferred examples of such materials are the higher fatty alcoholpolyethylene oxide condensates wherein the higher fatty alcohol is of 10 to 18 carbon atoms, preferably 12 to 15 carbon atoms, and the ethylene oxide portion thereof is a chain of 6 to 30 ethylene oxide units, preferably 7 to 15 ethylene oxide units and more preferably about 10 to 15 ethylene oxide units. Also useful are similar ethylene oxide condensates of phenols, such as nonyl phenol or isooctyl phenol.

In addition to the anionic and nonionic detergent compounds, both of which are preferable constituents of detergent compositions containing the present activated bleaching compositions, there may also be employed amphoteric and cationic detergents. The amphoteric detergents are those containing both anionic and cationic solubilizing groups and a hydrophobic organic group, which is advantageously a higher aliphatic radical containing about 10 to 20 carbon atoms. Examples of such products include the N-alkyl betaamino-lower alkanoic acids, the N,N-dilower alkylglycines, the fatty imidazoline and the betaines. The cationic detergents are usually those which contain 1 or 2 higher molecular weight substituents and 2 or 3 lower molecular weight substituents on a positively charged ammonium nucleus which also has a halide ion, preferably a chloride or bromide. The higher weight or long chain substituents are usually of 8 to 18 carbon atoms and preferably are lauryl, myristyl or stearyl, with stearyl being most preferred. The lower weight short chain substituents are preferably lower alkyl, such as alkyl of 1 to 4 carbon atoms, e.g., methyl. Exemplary of the cationic detergents are distearyl dimethyl ammonium chloride, cetyltrimethyl ammonium bromide, benzyl dimethylstearyl ammonium chloride and dimethyl propyl myristyl ammonium chloride and the corresponding bromides or chlorides.

Although the non-built detergent compositions intended for light duty uses, such as dishwashing, sterilization, fabric softening and cleaning of delicate materials, may be made without builder salts, normally such salts are incorporated in pre-soak compositions, heavy duty detergent products, denture cleansers and scouring powders. The most preferable of the builder salts are the alkali metal salts, preferably the sodium and potassium salts of inorganic acids, e.g., pentasodium tripolyphosphate, tetrasodium pyrophosphate, sodium silicates, preferably of $Na_2O:SiO_2$ ratios of 1:1.6 to 1:2.6, sodium carbonate, potassium bicarbonate and borax. Inorganic builders are preferred but organic builders are also useful, e.g., trisodium nitrilotriacetate, sodium citrate, potassium gluconate, hydroxyethyl iminodiacetate, disodium salt. With the builder salts there may sometimes be employed filler salts, such as alkali metal halides and sulfates, e.g., sodium chloride, sodium sulfate.

In the detergent compositions there may also be present enzymes for assisting and breaking down the molecular structures of various stains and thereby removing them from the substrates to which they are attached. Such enzymes are usually proteolytic enzymes, e.g., protease (sold under the trademark Alcalase) but also useful are amylotic and other enzymes, e.g., amylase. Various other components may be present in the detergent compositions, including soil suspending agents, anti-redeposition agents, hydrotropes, wetting agents, flow-improving agents, sequestrants, bactericides, fluorescent brighteners, stabilizers, fillers, coating agents, fungicides, emollients, perfumes, colorants and solvents. Also, various components of the compositions may be coated or encapsulated to prevent interaction thereof with other composition ingredients. Thus, for example, the activators or peroxy bleach materials may be coated or encapsulated with water-dispersible polyethylene glycol solids (Carbowax), polyvinyl alcohol, paraffinic waxes, vegetable waxes, monoglycerides and other suitable protective coverings. Furthermore, the protective coatings for the activators and peroxy bleach materials may include dextrin, dextrin containing a dispersing aid such as sodium lauryl sulfate, plasticized dextrin, carboxymethyl starch, sodium carboxymethyl cellulose or potato flour or other suitable materials, as described in Netherlands patent application Ser. No. 73/07820, filed by Henkel & Cie., GmbH on June 5, 1973, and Swedish patent application Ser. No. 72/005711, filed by Unilever N. V. on Apr. 28, 1972, both of which are incorporated herein by reference. The coatings may be applied by pan-mixing, spraying, solvent application and various other means known to the art and by methods described in the aforementioned applications.

More extended descriptions of the various ingredients of the present detergent compositions and other preparations including the activated bleach compositions of this invention are found in my U.S. Pat. Nos. 3,637,339; 3,640,874; 3,655,567; and 3,714,050, the disclosures of which are incorporated herein by reference. Also included by reference are the various synthetic organic detergents described in those patents, enzymes, adjuvants, bleaches and activators and the proportions and conditions under which such materials are employed, together with methods for manufacturing them and components thereof.

Additional descriptions of the detergents that are useful and accompanying builders, adjuvants, etc., are found in the texts *Surface Active Agents and Detergents*, Vol. II, by Schwartz, Perry and Berch, published in 1958 by Interscience Publishers, Inc., especially at pages 25–138, and in *Detergents and Emulsifiers*, 1969 *Annual*, by John W. McCutcheon.

The proportions of the activated bleach compositions in the detergent compositions will normally be from 4 to 60% thereof, with the peroxy compound being from 3 to 40% and with the mixture of activators being from 1 to 20% thereof. Normally, the total bleach composition content in the detergent products is from 7 to 50%, preferably from 8 to 35% and the peroxy compound content is from 5 to 35%, preferably from 5 to 25% while the total of activators is from 2 to 15%, preferably 3 to 10%. The anionic detergent compound content, preferably anionic detergent, a mixture of anionic and nonionic detergent or sometimes, nonionic detergent alone, is from 5 to 35%, preferably 10 to 30% and most preferably about 15 to 30%. Builder salt content is usually in the range of 10 to 60% or 70%, preferably being from 15 to 50% and more preferably being from 20 to 40%. Inorganic filler salt content will usually be from 5 to 50%, preferably from 10 to 45% and more preferably from 20 to 40%. In most cases the inorganic filler salt will be sodium sulfate. In non-phosphate formulas the pecentages of anionic detergent will preferably be increased over those present in phosphate detergent compositions and sodium silicate ($Na_2O:SiO_2$ ratio of about 1:2 ; to 1:2.6 or 1:3) will be employed (generally of such ratios of 1:2.3 to 1:2.5). The percentages of various adjuvants utilized will usually be from 0.01 to 5%, with the total thereof being from 1 to 10%. Thus, the percentage of soil suspending agent, such as sodium carboxymethyl cellulose, may be from 0.5 to 2% and a percentage of flow improving agent (calcium magnesium silicate) may be from 0.2 to 2%, while that of fluorescent brighteners or dyes may range from 0.01 to 2%, depending on the particular compounds utilized. The various proportions given for the detergent composition apply when the peroxy compound content is such as to yield about 2.5% or less active oxygen by weight. When more than 2.5% of active oxygen is present, such as when the proportion of sodium perborate is greater than 25%, the proportion of filler salt and builder salt will usually be decreased accordingly.

The detergent composition, except for the peroxy compound, and activators, is preferably produced by conventional spray drying operations and is generally in bead form with particle sizes such that substantially all of the product, over 95%, passes through a No. 8 U.S. Standard Sieve Series sieve and less than 10% of the product and preferably less than 5% thereof passes through a No. 100 sieve. Preferably, the remaining portion of the formula will be similarly sized, either by aggregation of particles or coating thereof with protective materials but it may also be in finely divided powder form, such as will pass through a No. 100 sieve and rest on No. 325 sieve, in which case the powder tends to adhere to the larger spray dried detergent particles. The coated particles mentioned will usually contain from 5 to 75% of coating material, preferably about 30 to 60% and normally about 50%, which may be at least partially replaced by an aggregating material such as a gum, adhesive or crystal-forming salt. The moisture contents of the spray dried detergent beads or other form of detergent particles employed will normally be from 1 to 15%, most usually about 3 to 12%. The moisture content of the peroxy compound and the activators therefor will preferably be limited to the water of crystallization contained therein, with a permissible excess that is rarely over 3%, and preferably, with no excess.

In the use of the bleaching composition as a sterilizing medium or a denture cleanser the proportion of synthetic organic detergent may be diminished to as little as 1% or it may be omitted entirely and the various adjuvants may also be omitted from the formula. To make a scouring powder the detergent formula may be employed but with from 80 to 95% of the total formula being a scouring powder material, such as finely divided silica (silex), which is added to it. In denture cleansers and sterilizers the proportions of bleaching composition present may be increased, sometimes to two or four times the proportion in the detergent composition. Similarly, for bleaching applications the concentration of bleaching composition in the aqueous medium employed may be greatly increased, usually being up to 1% in such applications.

The present compositions are employed in the same manner as comparable products not containing the bleaching components. Thus, they may be used for cold, warm and hot water washing, usually in the temperature range of 10° to 70°C. Of course, as with all bleaching operations, care should be taken in the selection of materials to be bleached but apart from this general precaution, the present compositions may be employed with safety, giving effective bleaching, even with colored goods, without seriously adversely affecting dye fastness. Excellent cold and warm water bleaching is obtainable, comparable to utilization of the same proportion of peroxy compound, such as sodium perborate, at or near the boil. When employing detergents, the washing times need not be changed from ordinary wash cycle times, usually being from 3 to 45 minutes, preferably being from 5 to 20 minutes in the United States and from 20 to 40 minutes according to European practice. Similar or corresponding times may also be employed with respect to other applications of the bleaching compositions, such as those previously mentioned, or the corresponding application times normally utilized for such products may be employed.

As a result of utilizing the compositions and processes of this invention greatly improved bleaching effects are obtained with activated peroxy bleach compounds without the need to raise any aqueous medium employed to the boiling point. Also, the activated bleaching compositions and materials including them are especially good for removing a wide variety of difficult to remove stains from fabrics, including coffee, tea, wine and dye stains or for significantly decreasing their concentrations. Such desirable results are obtained without harming fabrics and without serious adverse affects on dyed fabrics, such as blue dyed polyester-cotton blends, which are often used as test fabrics to determine the safeness of bleaches. Additionally the oxygen releasing compositions also possess antimicrobial properties.

The invention will be further illustrated by the following examples thereof. Unless otherwise indicated, all parts therein and in the specification are by weight and all temperatures are in °C.

EXAMPLE 1

Using a laboratory washing machine, a tergotometer, turning at 100 revolutions per minute (r.p.m.), a mixed load of stained cotton fabric, blue-dyed cotton-polyester blend (50—50) fabric and non-colored clean cotton fabric is agitated for 15 minutes in 1 liter of water at 24°C., containing a cold water detergent composition fortified with varying proportions of sodium perborate, BHADT, DDG and with mixtures of BHADT and DDG. Reflectance readings (Rd) for all cloths are taken with a Gardner Color Difference Meter before and after completion of the washings and for the dyed fabric, *b* readings are also recorded. Numerical differences between such readings are recorded as ΔRd and Δ*b*. With respect to stain removal and ΔRd, the higher the value the greater the improvement in bleach-whiteness (or bleaching and whiteness) due to washing and with respect to Δ*b*, the lower or more negative the value the less the change from desirable blue to undesirable yellow color. Thus, high ΔRd values for stained fabrics and low Δ*b* values for blue dyed fabrics are preferable. For blue fabrics it is usually desirable for ΔRd to be low, indicating that the blue color has not been destroyed but it may change to show removal of an objectionable stain.

The detergent used is one which includes 9% of sodium linear tridecyl benzene sulfonate, 4% of post-added higher fatty alcohol polyethoxylate wherein the fatty alcohol is of 12 to 15 carbon atoms and there are present seven mols of ethylene oxide, 32% of pentasodium tripolyphosphate, 7% of sodium silicate ($Na_2O$:-$SiO_2$ ratio of 1:2.4), 0.5% of sodium carboxymethyl cellulose, 11% moisture, 0.9% fluorescent brightener and 0.01% preservative, with the balance being sodium sulfate, except for very minor components and impurities. In the bleaching detergent composition solutions in aqueous media (wash water) the detergent composition described, without peroxy bleach compound or activators, is present at a concentration of 4.25 grams per liter. Two swatches (3 by 6 inches each) of the stained and dyed fabric and four swatches (2.25 inches square) of non-colored clean swatches comprise the mixed load. In Table 1 the contents of sodium perborate, BHADT and DDG and the pH's of the solutions upon completion of the wash are given. Also, stain removal results (ΔRd) for coffee-tea, Empa-114 (red wine) and Empa-115 (sulfo-dyed) bleach test cloths and the relative safety (ΔRd and Δ*b*) against color damage experienced by Wamsutta blue cotton/polyester blend exposed to the various activated bleach systems are presented. In the various experiments run and reported herein the detergent-bleach-activator mix mixture may be made up before dissolving in the wash water or may be made in the wash water by sequential additions of the various components. The detergent is of a particle size distribution so that over 95% passes through a No. 8 U.S. Standard Sieve Series sieve and less than 5% passes through a No. 100 sieve. The perborate - activator combination is of separate powders which pass a No. 100 sieve and rest on a No. 325 sieve. The per-compound and the activators may be coated with a protective coating, such as dextrin or CMC and may be aggregated to the detergent bead size.

TABLE 1

| BLEACH SYSTEM | | | | ΔRd: STAINED COTTON | | | WAMSUTTA BLUE COTTON/ POLYESTER | |
|---|---|---|---|---|---|---|---|---|
| ACTIVATOR (g./l.) | | SODIUM PERBORATE (g./l.) | pH | Coffee + Tea | EMPA 114 | EMPA 115 | ΔRd | Δb |
| BHADT | (0.21) | 0.50 | 9.4 | 6.4 | 22.0 | 20.7 | 1.4 | 0.5 |
| BHADT | (0.41) | 0.50 | 9.0 | 6.7 | 22.7 | 30.2 | 1.9 | 1.9 |
| DDG | (0.21) | 0.50 | 9.4 | 2.0 | 18.5 | 1.9 | 1.1 | −0.6 |
| DDG | (0.41) | 0.50 | 9.2 | 3.5 | 18.6 | 2.5 | 1.5 | −0.9 |
| BHADT + DDG | (0.21) (0.21) | 0.50 | 9.0 | 6.3 | 26.9 | 21.0 | 1.3 | 0.0 |
| BHADT + DDG | (0.41) (0.41) | 1.0 | 8.7 | 8.9 | 28.4 | 30.0 | 1.6 | 0.2 |
| NONE | | None | 9.8 | −1.6 | 6.0 | 1.5 | 1.0 | −0.6 |
| NONE | | 0.50 | 9.9 | −0.2 | 6.9 | 1.9 | 1.3 | −0.7 |

It will be noted that BHADT activated perborate at 24°C. is much better than is the DDG activated perborate for stain removal but it has a greater adverse effect upon color of the dyed fabric (a change in Δ*b* value of +0.5 is slightly noticeable and a change of +1.9 is highly noticeable under north daylight). By supplementing a quantity of BHADT (which can be damaging to color) with an equivalent quantity of DDG, such damage to color becomes about nil and stain removal is improved. The conclusion reached is that by utilizing the mixed activators with sodium perborate in the proportions described, improved bleaching is obtained, with discoloration of dyed fabric being reduced considerably, if not entirely eliminated. Such a result is unpredictable and surprising.

Similarly, improved results in bleaching and dye safety are also obtained when the per-compound-activator mixture combinations of the invention described in this example are employed without detergent composition ingredients (without active detergents, builders, anti-redeposition agents, etc.). In such cases it is desirable to adjust the pH of the bleaching medium to that of the corresponding detergent wash water, as by addition of sodium carbonate or other suitable alkaline material, e.g., alkaline salt. Also, when an equivalent proportion of sodium or potassium percarbonate is substituted for the sodium perborate, or when potassium perborate is used instead, similar bleaching results.

EXAMPLE 2

Following the procedure of Example 1 but utilizing a different detergent and different activators and proportions thereof, another series of tergotometer test washings is carried out, this time in medium temperature (60°C.) water. A control is also employed. The detergent utilized is intended for medium to hot (30° to 100°C.) water use and comprises 15% of the previously described linear alkyl benzene sulfonate, 1% of polyethoxylated higher fatty alcohol wherein the higher fatty alcohol is of 14 to 15 carbon atoms and the ethylene oxide:higher fatty alcohol molar ratio is 11:1, 32% of pentasodium tripolyphosphate, 7% of sodium silicate ($Na_2O$:$SiO_2$ = 1:2.35), 1% borax, 0.3% sodium carboxymethyl cellulose, 11% moisture, 0.7% fluorescent brighteners and the balance sodium sulfate, anhydrous. The test was conducted with the mixed load being the same as in Example 1 except the blue cotton/polyester was sheet material made by Burlington House. The results are reported in Table 2 below.

TABLE 2

| ACTIVATOR (g./l.) | | Sodium PERBORATE (g./l.) | ΔRd STAINED COTTON TEST FABRICS COFFEE TEA | EMPA 114 | EMPA 115 | BURLINGTON HOUSE BLUE COTTON/POLYESTER ΔRd | Δb |
|---|---|---|---|---|---|---|---|
| NONE | (Control) | 0.50 | 1.9 | 20.4 | 6.0 | 1.2 | 0.2 |
| BHADT | (0.25) | 0.50 | 8.8 | 26.2 | 22.0 | 1.6 | 0.4 |
| TAG | (0.25) | 0.50 | 7.0 | 30.1 | 8.5 | 1.5 | 0.1 |
| BHADT + TAG | (0.125) (0.125) | 0.50 | 8.3 | 31.5 | 14.9 | 1.8 | 0.1 |
| BHADT + TAG | (0.188) 0.05 (0.062) | 7.4 | 31.7 | 17.5 | 1.4 | 0.1 | |
| BHADT + TAG | (0.062) (0.188) | 0.50 | 6.7 | 32.7 | 11.0 | 1.3 | 0.0 |

It will be noted that stains from Empa 115 and coffeetea are better removed from cloths at 60°C. by BHADT than by TAG with perborate but stain from Empa 114 (red wine) is better removed when the activator is TAG. By using compositions which include BHADT and TAG significant improvement is made with respect to overall stain removal, particularly with respect to the removal of the stain from Empa-114. By varying the proportions of BHADT and TAG within the range given in this specification formulas are modified for most desired activity against specific stains.

It will be understood that one may also utilize only the perborate and activator mixture as bleaching material in the tergotometer (without other detergent, builder and adjuvant constituents). Also, one may mix 10 parts of the formula of Example 2 with 90 parts of finely divided silica polishing agent (silex, such as is employed in commercial scouring cleansers) to produce a bleaching scouring composition. The foregoing detergent composition or bleaching composition formula (the latter being without detergent, builder and adjuvants but including the filler) may also be employed as a useful denture cleanser. Others of the described oxygen-releasing per-compounds and activators (in the mixtures taught) may be substituted in these examples for the perborate and activators shown, to produce similar bleaching products. For example sodium perborate monohydrate, potassium percarbonate, sodium peroxypyrophosphate, sodium peroxysilicate, sodium persulfate, sodium peroxide, urea peroxide and other oxygen releasing compounds may be employed, alone or in mixtures, with some being employed only as supplements. As activators, those mentioned in the specification may be substituted, as directed, either in whole or in part, using at least one of each type, acyl and triazine, in the proportions described and in suitable described total proportion, with respect to the "per-compound". In the products described, for best results pH should be controlled, as by addition of alkaline material, e.g., sodium carbonate, trisodium phosphate, sodium silicate, potassium hydroxide, preferably maintaining it about 9 or 10 but sometimes allowing it to be in the 8.5 to 10.5 or 11 range.

EXAMPLE 3

The procedure of Example 1 is followed, with washing of the mixed load of fabrics of Example 2 being conducted in 24°C. tap water (of about 100 parts per million hardness), using a tergotometer laboratory washing machine containing one liter of water. With the 4.25 grams of detergent composition, which is of the same formula as the detergent composition described in Example 2, there are present 0.50 g. of sodium perborate and the indicated amounts of the identified mixed activators. Results of the washing and bleaching are given in Table 3. The pick-ups of brightener (fluorescent intensity) for the non-soiled, non-colored fabrics without brightener included in the wash were measured with a Galvanek-Morrison Fluorimeter.

TABLE 3

| ACTIVATOR (g./l.) | | Rd-STAIN REMOVAL COFFEE/ TEA | EMPA 114 | EMPA 115 | CLEAN FABRIC ΔRd | F.I. |
|---|---|---|---|---|---|---|
| NONE | | 0.6 | 8.8 | 1.6 | −2.2 | 350 |
| BHADT | (0.25) | 7.0 | 23.1 | 26.0 | −0.1 | 335 |
| TAG | (0.25) | 2.8 | 18.8 | 2.4 | −1.2 | 340 |
| BHADT + TAG | (0.125) (0.125) | 6.9 | 24.5 | 14.5 | 0.1 | 360 |
| BHADT | (0.50) | 7.2 | 24.5 | 31.5 | 0.2 | 290 |
| TAG | (0.50) | 3.7 | 21.3 | 2.7 | −1.2 | 345 |
| BHADT + TAG | (0.25) (0.25) | 7.9 | 29.1 | 24.2 | +0.5 | 340 |

From the results tabulated, it is apparent that at 24°C. BHADT is a much better activator than TAG for stain removal and for the maintenance of whiteness of non-soiled, clean fabric but perborate activated with BHADT has an adverse effect upon the fluorescent intensity of the white goods. By supplementing BHADT with TAG it is, under the higher concentration conditions given above, possible to obtain overall stain removal and whiteness retention comparable to that obtainable with BHADT without having an adverse effect upon brightener effectiveness.

When the same test is repeated, using an equivalent proportion of sodium percarbonate (0.39 g.)., similar results are obtainable. The described compositions are superior to the control wherein no activator is employed.

EXAMPLE 4

The laboratory tergotometer washing machine with one liter of 60°C. tap water therein is employed to wash a load of fabrics as described in Example 2. The detergent employed is that of Example 2, at a concentration of 4.25 grams per liter and 0.50 g./l. of sodium perborate is present as the peroxy bleach. The changes in reflectance and brightener intensity of the clean fabric present in the wash load are given in Table 4 below.

TABLE 4

| ACTIVATOR (g./l.) | | REFLECTANCE AND BRIGHTENER EFFECTS — CLEAN FABRIC | |
|---|---|---|---|
| | | ΔRd | BRIGHTENER INTENSITY |
| NONE | | −3.3 | 425 |
| BHADT | (0.25 | −0.3 | 420 |
| TAG | (0.25) | −1.7 | 450 |
| BHADT | (0.125) | | |
| + | | −0.3 | 450 |
| TAG | (0.125 | | |
| BHADT | (0.50) | +0.4 | 310 |
| TAG | (0.50) | −1.1 | 440 |
| BHADT | (0.25) | | |
| + | | +0.2 | 440 |
| TAG | (0.25) | | |

From the data given in Table 4, it is apparent that at a wash temperature of 60°C., as at 24°C. (Example 3), better whiteness retention, coupled with better brightener effectiveness on cloth, is obtained with the use of perborate detergent compositions containing mixed activators than with the use of either a single acyl type activator or a single triazine type activator.

Results similar to those reported in Table 4 are obtained when an equivalent proportion of sodium percarbonate is used instead of sodium perborate.

EXAMPLE 5

In a practical laundry test, using a German make washing machine (Prima) of about three gallon capacity, a five pound load of medium soiled white and colored home laundry items plus a variety of test stained cotton (C) and polyester-cotton (P/C) fabrics was washed for thirty minutes in 27°–60°C. temperature range water containing 76.5 g. of the detergent composition of Example 1 with 9.0 gram of sodium perborate tetrahydrate (Formula 5). Another similarly matched load was washed using Formula 5 with an additional 2.3 g. of BHADT and 2.3 g. of TAG (Formula 5*a*). Percentages of stain removal for the various test stains are given in Table 5 for perborate detergent without activator (Formula 5) and for the same perborate detergent with the mixed activator system (Formula 5*a*).

TABLE 5

| TEST STAINS | STAIN REMOVAL (%) | |
|---|---|---|
| | FORMULA 5 | FORMULA 5a |
| GRAPE (P/C), aged 1 year | 60 | 81 |
| GRAPE (C), aged 1 year | 74 | 92 |
| SPAGHETTI (P/C), fresh | 85 | 86 |
| SPAGHETTI (C), fresh | 75 | 89 |
| BEET (P/C), fresh | 90 | 92 |

TABLE 5-continued

| TEST STAINS | STAIN REMOVAL (%) | |
|---|---|---|
| | FORMULA 5 | FORMULA 5a |
| BEET (C), fresh | 94 | 97 |
| CHOCOLATE (P/C), fresh | 96 | 96 |
| CHOCOLATE (C), fresh | 94 | 94 |
| COFFEE/TEA (C) | 10 | 61 |
| EMPA-114 (red wine on C) | 43 | 79 |
| EMPA-115 (sulfo dye on C) | 6 | 32 |

Neither the non-activated (Formula 5) nor the activated perborate (Formula 5*a*) detergent damaged any of the colored items present. Removal of freshly applied stains was high and therefore differences between the Formula 5 and 5*a* were not too obvious either visually or instrumentally. However with the other test stains, significant improvement results with the use of the activated perborate composition, Formula 5*a*, over that of the perborate composition, Formula 5.

In a modification of this experiment the 76.5 grams of the detergent composition of Example 1 is replaced with the same weight of detergent composition of Example 2 and good bleaching results.

EXAMPLE 6

In a practical laundry test employing a Kenmore washing machine of 14 gallons tub capacity and washing in it a five pound medium soiled mixed white and colored home laundry items load, with test stains on cotton (C) and polyester-cotton (P/C) fabrics, operating over a wash period of 12 minutes at a temperature of 46°C., Formula 5*a* was tested, employing 90 g. of the test composition. In Table 6, following, the results of such test are given.

TABLE 6

| TEST STAINS | STAIN REMOVAL (%) |
|---|---|
| GRAPE (P/C) | 67 |
| GRAPE (C) | 86 |
| SPAGHETTI (P/C) | 82 |
| SPAGHETTI (C) | 90 |
| BEET (P/C) | 88 |
| BEET (C) | 95 |
| CHOCOLATE (P/C) | 93 |
| CHOCOLATE (C) | 92 |
| COFFEE/TEA (C) | 41 |
| EMPA 114 (red wine on cotton) | 66 |
| EMPA 115 (sulfo dye on cotton) | 17 |

The stain removals obtained are superior to those when the same composition, less the activators, is employed in the same test, except for approximately equivalent removals of chocolate stains.

It will also be appreciated that the proportion of perborate may be changed, to 7% and 15% and up to 25% of the detergent composition, with the proportions of activators being adjusted accordingly. Further, the detergent composition content of the formula maybe omitted, changed or replaced with other detergent compositions, such as: (a) a non-phosphate heavy duty detergent containing 23% of sodium linear dodecyl benzene sulfonate, 25% sodium silicate solids ($Na_2O$:-$SiO_2$ ratio of 1:2.4), 1% borax, 4.5 ethoxylated higher fatty alcohol wherein the higher fatty alcohol is of 16 to 18 carbon atoms and the ethylene oxide content is about 10.3 mols per mol, 2% higher fatty acid sodium soap, 1% sodium carboxymethyl cellulose, 1% of flow improving agent (magnesium aluminum silicate), 1% of mixed fluorescent brighteners, 0.01% of stabilizer and 4.5% of moisture, with the balance being sodium sulfate; (b) another non-phosphate heavy duty detergent containing 18% sodium linear dodecyl benzene sulfonate, 25% of sodium silicate solids ($Na_2O$:$SiO_2$ = 1:2.40), 4.0 ethoxylated alcohol ($C_{16-18}$ higher fatty alcohol with 10 ethylene oxides per mol),. 1% sodium carboxymethyl cellulose, 0.8% of fluorescent brightener, 0.03% of colorant, 4.5% of moisture, 1% of magnesium aluminum silicate flow improving agent and 6% of higher fatty acid sodium soap, with the balance being sodium sulfate; (c) a typical European heavy duty detergent with which about 33 parts per hundred of sodium perborate will often be added for boiling washings, containing 8% sodium linear dodecyl or tridecyl benzene sulfonate, 4% of the nonionic detergent of (a) supra, 7% of higher fatty acid soap, 48% of pentasodium tripolyphosphate, 8% of the silicate of (a) supra, 0.3% of fluorescent brightener, 0.4% of proteolytic enzyme (Alcalase) and the balance water and adjuvants; and (d) 8%, 4%, 2%, 60%, 6%, 0.25% and 0.9% of the materials recited in (c) supra. Also, the sodium linear alkyl benzene sulfonate of such and other useful detergent composition formulations may be replaced by sodium higher fatty alcohol sulfate, sodium paraffin sulfonate, sodium alpha-olefin sulfonate, sodium higher fatty alcohol polyethoxy sulfate and other commercial anionic synthetic organic detergents, wherein the higher alkyl is usually of 10 to 18 carbon atoms, preferably of 12 to 16 carbon atoms, and wherein, when present, there are 5 to 30 ethoxies per mol. Also, partial replacements of the sodium linear higher alkyl benzene sulfonate may be made with such detergents. Various adjuvants may also be included, such as other enzymes (amylotic too) and builders may be charged (non-phosphate, high and intermediate phosphate contents are operative). The products made may be spray dried, except for the sodium perborate and activator contents. They also may be granulated crystallized, flaked, admixed, co-sprayed, sprayed onto tumbling powders, co-size reduced, encapsulated or made by a method such as the Chemserve process. For improved storage stability the activators in all such compositions, which are in particulate form, may be coated with 50% by weight of Carbowax (polyethylene glycol) and in some cases, stearic acid or paraffin. When no surface active agent or detergent is present to dissolve or disperse the coating layer, it is preferable to choose a water soluble coating, e.g., polyvinyl alcohol, to the extent of about 50% by weight of the activator, for example. If desired, the peroxy compound is also coated with such protective coating but normally such coating will be only 5 to 20% by weight of the peroxy compound, when employed.

EXAMPLE 7

The bleach promotion and dye safety of a peroxy compound (sodium perborate) are evaluated with data being taken after 1 and 5 washes. The detergent composition employed is 4.25 g. of that of Example 2 per liter of 60°C. tap water in 15 minute washes in the tergotometer, with 0.5 gram of sodium perborate (P) and the indicated amounts of activators. The mixed load is the same as that of Example 1 and the results thereof are given in Table 7.

TABLE 7

| | ΔRd: STAINED COTTON | | | | | | WAMSUTTA BLUE COTTON/POLYESTER | | | |
|---|---|---|---|---|---|---|---|---|---|---|
| | COFFEE/TEA WASHES | | EMPA 114 (WINE STAIN) WASHES | | EMPA 115 (SULFO DYE) WASHES | | ΔRd WASHES | | Δb WASHES | |
| BLEACH SYSTEM | 1 | 5 | 1 | 5 | 1 | 5 | 1 | 5 | 1 | 5 |
| *DC only | 0.5 | 3.3 | 7.5 | 12.9 | 5.1 | 8.5 | 1.6 | 2.9 | −0.9 | −1.1 |
| DC + Sodium Perborate (P) | 2.4 | 8.4 | 15.4 | 35.0 | 6.0 | 13.1 | 1.4 | 3.0 | −0.8 | −1.3 |
| DC + P + DCT (0.25 g.) | 8.4 | 10.9 | 26.9 | 37.8 | 33.3 | 61.2 | 2.3 | 5.0 | 1.8 | 3.5 |
| DC + P + DCT (0.25 g.) + DDG (0.25 g.) | 9.5 | 11.0 | 36.0 | 40.1 | 30.4 | 60.7 | 2.0 | 3.8 | −0.6 | 0.1 |
| DC + P + DCT (0.125 g.) + DDG (0.125 g.) | 8.1 | 10.7 | 32.8 | 40.4 | 18.0 | 55.5 | 2.0 | 3.8 | −0.9 | −0.5 |

*Detergent composition only (no perborate and no activators)

It is apparent from the table that after five washes the mixed activator composition containing an amount of activator equivalent to that in the single DCT activator composition is of about the same effect in bleaching of stains but, surprisingly, is much better in retaining the desired blue color of the blue cotton/polyester fabric. After a single wash the improvement in dye stability is observable but the "experimental" product is less efficient in removing sulfo dye stain (EMPA 115). However, it is better with respect to removing EMPA 114 (red wine) stain.

When in this example TAG is substituted for DDG, such results are also obtainable.

With respect to the foregoing examples changes may be made in the proportions, detergent composition constituents, bleaches, activators, pH's and physical forms of the product, as described in the specification, and improved bleaching is obtainable. When the mentioned peroxysilicate and peroxypyrophosphate are used instead of perborates and percarbonates and when potassium peroxy salts are employed improved products can also result. When other activators of the acyl and triazine classes, previously mentioned, are substituted for those disclosed in these examples, either in whole or in part, such good properties may also be obtained. Products made can be satisfactorily stable, readily pourable, easy to employ by the housewife and what is most important, safer to colored fabrics than many other commercially available bleaching agents. While not all of such compositions are equivalent to commercial perborate detergents subjected to European washing conditions involving boiling of the laundry in the wash water, many are. Also, while in some instances fabrics might be bleached slightly by them, the invented compositions are safer in this respect, losing less color, than solely triazine activated perborate and percarbonate compositions.

The invention has been described with respect to various examples thereof but is not to be limited to these because it is evident that one of skill in the art will be able to utilize substitutes and equivalents without departing from the spirit of the invention or going outside the scopes of the claims.

What is claimed is:

1. An activated peroxy compound bleaching composition comprising a peroxy bleaching compound and a mixture of activators for such compound, at least one of which is (a) an activator selected from the group consisting of di-lower alkanoyl di-lower alkyl glyoxime, tetra-lower alkanoyl glycoluril and mixtures thereof and at least another of which is (b) an activator selected from the group consisting of 2-[di(2-hydroxy-lower alkyl)amino]-4,6-dihalo-s-triazine, 2,4-di-lower alkoxy-6-halo-s-triazine and mixtures thereof, the ratio of active oxygen available from said peroxy bleaching compound to said mixture of activators for such compound being in the range of about 1:12 to 5:1, and the ratio of activator (a) to activator (b) being in the range of about 1:5 to 5:1.

2. An activated bleaching composition according to claim 1 wherein the peroxy compound is selected from the group consisting of alkali metal perborates and alkali metal percarbonates, the di-lower alkanoyl di-lower alkyl glyoxime is diacetyldimethylglyoxime, the tetra-lower alkanoyl glycoluril is tetraacetylglycoluril, the 2-[di(2-hydroxy-lower alkyl)amino]-4,6-dihalo-s-triazine is 2-[bis(2-hydroxyethyl)amino]-4,6-dichloro-s-triazine and the 2,4-di-lower alkoxy-6-halo-s-triazine is 2,4-dimethoxy-6-chloro-s-triazine.

3. An activated bleaching composition according to claim 2 wherein the peroxy compound is a sodium salt.

4. An activated bleaching composition according to claim 3 wherein the mixture of activators includes BHADT and DDG.

5. An activated bleaching composition according to claim 3 wherein the mixture of activators includes BHADT and TAG.

6. An activated bleaching composition according to claim 3 wherein the mixture of activators includes DCT and DDG.

7. An activated bleaching composition according to claim 3 wherein the mixture of activators includes DCT and TAG.

8. An activated bleaching composition according to claim 3 wherein the peroxy compound is selected from the group consisting of sodium perborate and sodium percarbonate.

9. An activated bleaching composition according to claim 4 wherein the peroxy compound is selected from the group consisting of sodium perborate and sodium percarbonate.

10. An activated bleaching composition according to claim 5 wherein the peroxy compound is selected from the group consisting of sodium perborate and sodium percarbonate.

11. An activated bleaching composition according to claim 10 wherein the peroxy compound is sodium perborate.

12. An activated bleaching composition according to claim 10 wherein the peroxy compound is sodium percarbonate.

13. An activated peroxy compound bleaching composition according to claim 8 wherein the ratio of peroxy bleaching compound to mixture of activators for such compound is in the range of about 1:10 to 1:1.7 for active peroxy compound oxygen to activator.

14. An activated peroxy compound bleaching composition according to claim 10 wherein the ratio of peroxy bleaching compound to mixture of activators for such compound is in the range of about 1:10 to 1:1.7 for active peroxy compound oxygen to activator.

15. An activated sodium perborate bleaching composition according to claim 13 wherein the ratio of activators, a:b, is in the range of about 1:3 to 3:1.

16. An activated sodium perborate bleaching composition according to claim 14 wherein the ratio of activators, a:b, is in the range of about 1:3 to 3:1.

17. A bleaching detergent composition comprising a normally solid synthetic organic detergent selected from the group consisting of anionic and nonionic detergents and mixtures thereof, a peroxy bleaching compound and a mixture of activators for such peroxy bleaching compound, at least one of which is (a) an activator selected from the group consisting of di-lower alkanoyl di-lower alkyl glyoxime, tetra-lower alkanoyl glycoluril and mixtures thereof and at least another of which is (b) an activator selected from the group consisting of 2-[di(2-hydroxy-lower alkyl)amino]-4,6-dihalo-s-triazine, 2,4-di-lower alkoxy-6-halo-s-triazine and mixtures thereof, the ratio of active oxygen available from said peroxy bleaching compound to said mixture of activators for such compound being in the range of about 1:12 to 5:1, and the ratio of activator (a) to activator (b) being in the range of about 1:5 to 5:1.

18. A detergent composition according to claim 17 wherein the anionic detergent is a sulfated or sulfonated detergent, the nonionic detergent is a condensation product of ethylene oxide, the peroxy bleaching compound is selected from the group consisting of alkali metal perborates and alkali metal percarbonates, the di-lower alkanoyl di-lower alkyl glyoxime is diacetyldimethylglyoxime, the tetra-lower alkanoyl glycoluril is tetraacetylglycoluril, the 2-[di(2-hydroxy-lower alkyl)amino]-4,6-dihalo-s-triazine is 2-[bis(2-hydroxyethyl)amino]-4,6-dichloro-s-triazine and the 2,4-di-lower alkoxy-6-halo-s-triazine is 2,4-dimethoxy-6-chloro-s-triazine.

19. A detergent composition according to claim 18 wherein the anionic detergent is a sodium linear higher alkyl benzene sulfonate, the nonionic detergent is a higher fatty alcohol polyethylene oxide condensate and the mixture of activators includes BHADT and DDG.

20. A detergent composition according to claim 18 wherein the anionic detergent is a sodium linear higher alkyl benzene sulfonate, the nonionic detergent is a higher fatty alcohol-polyethylene oxide condensate and the mixture of activators includes BHADT and TAG.

21. A detergent composition according to claim 19 which includes from 5 to 30% of sodium linear higher alkyl benzene sulfonate, the higher alkyl of which is of 12 to 15 carbon atoms, 1 to 10% of higher fatty alcohol-polyethylene oxide condensate, the higher fatty alcohol of which is of 12 to 15 carbon atoms and the ethylene oxide portion of which is a chain 7 to 15 ethylene oxide units long, a builder salt selected from the group consisting of pentasodium tripolyphosphate, sodium carbonate, sodium silicate and trisodium nitrilotriacetate and mixtures thereof, which is 10 to 60% of the composition, 3 to 40% of the peroxy compound which is sodium perborate and 1 to 20% of the mixture of activators, which are present in about equal quantities.

22. A detergent composition according to claim 20 which includes from 5 to 30% of sodium linear higher alkyl benzene sulfonate, the higher alkyl of which is of 12 to 15 carbon atoms, 1 to 10% of higher fatty alcohol polyethylene oxide condensate, the higher fatty alcohol of which is of 12 to 15 carbon atoms and the ethylene oxide portion of which is a chain 7 to 15 ethylene oxide units long, a builder salt selected from the group consisting of pentasodium tripolyphosphate, sodium carbonate, sodium silicate and trisodium nitrilotriacetate and mixtures thereof, which is 10 to 60% of the composition, 3 to 40% of the peroxy compound which is sodium perborate and 1 to 20% of the mixture of activators, which are present in about equal quantities.

23. A method of bleaching fabrics or articles made thereof which comprises contacting them with an activated peroxy compound bleaching composition, as set forth in claim 1, contained in an aqueous medium.

24. A method according to claim 23 wherein the bleaching composition is that of claim 3.

25. A method according to claim 24 wherein the bleaching composition is that of claim 13, the composition concentration in the aqueous medium is from 0.01 to 0.2% and the temperature of the aqueous medium is from 10° to 70°C.

26. A method according to claim 24 wherein the activated peroxy compound bleaching composition is that of claim 14, the composition concentration in the aqueous medium is from 0.01 to 0.2% and the temperature of the aqueous medium is from 10° to 70°C.

27. A method of washing and bleaching fabrics or articles made thereof which comprises contacting them with the bleaching detergent composition of claim 17, contained in an aqueous medium.

28. A method according to claim 27 wherein the bleaching detergent composition is that of claim 18.

29. A method according to claim 28 wherein the bleaching detergent composition is that of claim 19.

30. A method according to claim 28 wherein the composition is that according to claim 20.

31. A method according to claim 29 wherein the composition is that of claim 21, the composition concentration in the aqueous medium is from 0.05 to 1%, the temperature of the aqueous medium is from 10°C. to 70°C. and the pH is from 8 to 12.

32. A method according to claim 30 wherein the composition is that of claim 22, the composition concentration in the aqueous medium is from 0.05 to 1%, the temperature of the aqueous medium is from 10° to 70°C. and the pH is from 8 to 12.

33. An activated peroxy compound bleaching composition comprising a peroxy bleaching compound and a mixture of activators for such compound, at least one of which is an acyl activator which reacts with the peroxy anion of the peroxy compound to form a peracid, and the other of which is a triazine compound from which a peroxy anion from the peroxy compound displaces chlorine to form a hydroperoxide of the triazine compound, the ratio of active oxygen available from said peroxy bleaching compound to said mixture of activators for such compound being in the range of about 1:12 to 5:1, and the ratio of said acyl activator to said triazine compound activator being in the range of about 1:5 to 5:1.

34. An activated peroxy compound bleaching composition according to claim 33 wherein the peracid formed by the action of the peroxy compound with the acyl activator is peracetic acid.

35. A bleaching detergent composition comprising a normally solid synthetic organic detergent and an activated peroxy compound bleaching composition according to claim 33.

* * * * *